US006155479A

United States Patent [19]

Wellner et al.

[11] Patent Number: 6,155,479

[45] Date of Patent: Dec. 5, 2000

[54] SELF-ERECTING CONTAINERS

[75] Inventors: Kerry Donavon Wellner, Frisco, Tex.; Jeffrey S. James; Karen M. Chiera, both of Elmhurst, Ill.; Kenneth J. Zion, Villa Park, Ill.

[73] Assignee: Stone Bridge Corporation, Chicago, Ill.

[21] Appl. No.: 09/090,015

[22] Filed: Jun. 3, 1998

[51] Int. Cl.[7] ..... B65D 5/42

[52] U.S. Cl. ..... 229/117.08; 229/117.15; 229/186; 229/939

[58] Field of Search ..... 229/117.07, 117.08, 229/117.14, 143, 186, 117.15, 939

[56] References Cited

U.S. PATENT DOCUMENTS

| | | | |
|---|---|---|---|
| 413,784 | 10/1889 | Hotchkiss | 229/186 |
| 598,344 | 2/1898 | Ingrey | 229/186 |
| 615,417 | 12/1898 | Wilcox . | |
| 886,074 | 4/1908 | Reber . | |
| 916,509 | 3/1909 | Wade . | |
| 921,197 | 5/1909 | Zell . | |
| 922,345 | 5/1909 | Shaffer . | |
| 956,236 | 4/1910 | Wagnitz . | |
| 959,261 | 5/1910 | Reber . | |
| 991,052 | 5/1911 | Draper . | |
| 996,746 | 7/1911 | Bloomer . | |
| 1,003,150 | 9/1911 | Potter . | |
| 1,003,510 | 9/1911 | Reber . | |
| 1,040,984 | 10/1912 | Reber . | |
| 1,046,017 | 12/1912 | Reber . | |
| 1,046,945 | 12/1912 | Bauer et al. . | |
| 1,068,802 | 7/1913 | Merrell et al. . | |
| 1,088,964 | 3/1914 | Buchman . | |
| 1,135,588 | 4/1915 | Kendrick . | |
| 1,694,126 | 12/1928 | Joslin . | |
| 1,700,758 | 2/1929 | Berkowitz . | |
| 1,758,510 | 5/1930 | Gross . | |
| 1,926,366 | 9/1933 | Bergstein . | |
| 1,957,264 | 5/1934 | Gross . | |
| 2,036,460 | 4/1936 | Conescu . | |
| 2,185,353 | 1/1940 | Platt et al. . | |
| 2,227,383 | 12/1940 | Snyder . | |
| 2,255,223 | 9/1941 | Lighter . | |
| 2,293,342 | 8/1942 | Inman . | |
| 2,384,480 | 9/1945 | Lupton . | |
| 2,545,802 | 3/1951 | Bergstein | 229/117.07 |
| 2,713,963 | 7/1955 | Andrews et al. | 229/186 |
| 2,932,439 | 4/1960 | Sparling . | |
| 3,058,645 | 10/1962 | Luterick . | |
| 3,244,353 | 4/1966 | Miessler, Sr. | 229/939 |
| 3,905,544 | 9/1975 | Tipton . | |
| 3,927,824 | 12/1975 | Razziano . | |
| 4,148,429 | 4/1979 | Burr et al. . | |
| 4,361,236 | 11/1982 | Lavery . | |
| 4,441,626 | 4/1984 | Hall | 229/939 |

(List continued on next page.)

FOREIGN PATENT DOCUMENTS

| | | | |
|---|---|---|---|
| 2365488 | 4/1978 | France | 229/117.15 |
| 28 09 946 | 9/1979 | Germany . | |
| 36 10 615 | 10/1987 | Germany . | |
| 289495 | 3/1965 | Netherlands | 229/117.15 |

OTHER PUBLICATIONS

Fibre Box Association, "Marketing in Action Box–A–Rama 1974: Entries in the Box Competition", .

Box Expo 78, "Creative Corrugated Packaging", pp. 86, 97 and 94.

*Primary Examiner*—Gary E. Elkins
*Attorney, Agent, or Firm*—Dick and Harris

[57] ABSTRACT

Self-erecting containers, for forming, from folded, flattened, partially articulated and pre-glued blanks, containers having prismatic container enclosures, are provided. Pairs of corner panels join end panels to side panels. One of each pair of corner panels is affixed to one of opposed side or end panels, so that upon raising of the end or side panels, respectively, the corner panels cause the respective side or end panels to be automatically be raised relative to the bottom panel. The containers may include one or more top panels, with top support panels associated with the end, side or top panels, for supporting and locating the one or more top panels.

15 Claims, 11 Drawing Sheets

U.S. PATENT DOCUMENTS

| | | | |
|---|---|---|---|
| 4,447,004 | 5/1984 | House et al. . | |
| 4,465,227 | 8/1984 | Hood et al. . | |
| 4,607,786 | 8/1986 | Weaver . | |
| 4,791,883 | 12/1988 | Lehman et al. . | |
| 4,830,271 | 5/1989 | Lau et al. | 229/117 |
| 4,869,424 | 9/1989 | Wood | 229/113 |
| 4,895,250 | 1/1990 | Schfrin | 206/223 |
| 4,949,900 | 8/1990 | Ballu | 229/125.26 |
| 5,062,527 | 11/1991 | Westerman | 229/117 |
| 5,284,294 | 2/1994 | Floyd | 229/179 |
| 5,638,978 | 6/1997 | Cadiente . | |

SELF-ERECTING CONTAINERS

BACKGROUND OF THE INVENTION

1. The Technical Field

The present invention is directed to containers fabricated from cardboard, paperboard and corrugated paperboard and the like, which have a rectangular parallelpiped configuration when erected.

2. The Prior Art

In certain industries and businesses which employ rectangular parallelpiped containers fabricated from cardboard, paperboard, corrugated paperboard and the like, such as the fast food industry, the catering industry, the retail sale of consumer dry goods, etc., it is often important that the containers be configured to be articulated into their "use" configurations, in an efficient, reliable and rapidly executable manner.

An example of a rapid deployment container is shown in Westerman, U.S. Pat. No. 5,062,527. In the Westerman '527 patent, a "slotless" container is disclosed, which is lidless, and is formed from a single blank, which has no perforations, holes, apertures or cuts of any kind. The blank is divided by fold lines into a rectangular bottom panel, and rectangular side and end panels which contiguously emanate from the edges of the rectangular bottom panel. Square corner panels are positioned between and emanate from the edges of adjacent side and end panels. A central fold line bisects the blank from one end panel edge to the opposite end panel edge, and diagonal fold lines diagonally bisect the corner panels and extend into the bottom panel.

By bending the corner panels about the diagonal fold lines, so that the edges formed by the diagonal fold lines project toward the interior of the container, while simultaneously folding the side and end panels upward to positions perpendicular to the bottom panel, an open-topped rectangular parallelpiped container is formed. The panels in the apparatus of the Westerman '527 patent are sized so that the diagonal fold lines of the corner panels, upon completed articulation of the blank, extend all the way up to the "top" edges of the side and end panels. Thus, no paths for leakage of liquids is provided in the completely articulated container. However, as can be seen from the illustrations of the Westerman '527 patent, the folded corner panels overlap one another, when the container is in its fully erected configuration.

The Westerman '527 patent also discloses lining or coating the interior of the container with a liquid-proof material, in order to permit the erected container to be used to contain materials such as medical waste, without danger of leakage. A simple flat lid, fabricated from a separate structure or blank, is used to cover the container.

Another class of containers which address the foregoing issues is known generally as the class of "self-erecting" containers. An example of a self-erecting container is The Ice Cube™ corrugated ice chest/cooler container manufactured by Wesland Container of Little Rock, Ark. The configuration of the blank for the Wesland Container article is similar to that of the Westerman '527 apparatus, except that lid panels emanate from the upper edges of the side panels, and locking panels emanate from the upper edges of the end panels. Handle panels emanate from the upper, inner edges of the lid panels. In addition, the corner panels are not rectangular, but instead are formed from two trapezoidal members (left by removing squares, bisected by the diagonal fold lines, from the free corners of each of the corner panels.

By making the corner panels in the foregoing manner, and by appropriate proportioning of the dimensions of the various panels permits the folded corner panels to be folded against the inner surface of the side panels, and glued thereto, without the folded corner panels overlapping one another. An additional effect of the formation of the corner panels is that the diagonal fold lines do not reach to the top edges of the container, thus creating potential leakage flow paths.

By gluing one of each of the pairs of folded juxtaposed corner panels to the opposed inside surfaces of the side panels, upon folding the end panels and corner panels over the bottom and side panels, a self-erecting feature is created. After the glue has set, upon pulling up of the flattened end panels, the corner panels cause the side panels to be moved in concert with the end panels, to form the container enclosure.

The Wesland Container apparatus is likewise provided with the knock-down feature of the long fold line bisecting the entire blank, and the diagonal folds in the bottom panel, which permit the side panels to be pressed against one another, while the end panels are folded inwardly upon themselves to create a flattened, collapsed container.

The Wesland Container apparatus is likewise provided with a slotless, imperforate blank, and a liquid-proof coating on the inside surface of the blank, so that ice, etc., may be safely carried in the container, without leakage.

Closure of the Wesland Container is provided by folding the top panels over the container space. The handle panels are then folded upward to be perpendicular to the bottom of the container. The handle panels are also provided with hooks, which are engaged by slots on the lock panels.

It would be desirable to provide improved self-erecting container apparatus which are adapted for both fast and reliable deployment, and which incorporate other features of more conventional containers which will permit their use in a variety of applications.

This and other objects of the present invention will become apparent, in light of the present description, claims and drawings.

SUMMARY OF THE INVENTION

The present invention comprises a self-erecting container apparatus for rapid deployment into articulation for the facilitated containment of articles. The container includes a bottom panel, having two opposed end edge regions and two opposed side edge regions. Two end panels emanate from the end edge regions of the bottom panel, and having two side edge regions. Two side panels emanate from the side edge regions of the bottom panel, and having two side edge regions. A plurality of lines of weakness are disposed between the bottom panel and the end and side panels.

A plurality of paired corner panels are provided, one panel of each corner panel pair emanating from a side edge region of an end panel, the other panel of each corner panel pair emanating from a side edge region of a side panel. A line of weakness is disposed between the panels of each pair of corner panels.

One panel of each pair of corner panels is configured to be folded into a position overlying and juxtaposed to the side or end panel from which the one panel emanates, for affixation thereto, upon folding of the end or side panels into positions overlying and juxtaposed to the bottom panel. Raising of the end or side panels into positions substantially perpendicular to the bottom panel causes the counterpart side or end panels to be drawn by the corner panel pairs likewise into positions substantially perpendicular to the bottom panel.

At least one top panel is operably integrated into and emanates from a top edge region of one of the side panels, and operably configured for releasable affixation of the at least one top panel in a container closing position. At least one top support panel is operably associated with the top panel, for facilitating positioning of the at least one top panel, when the at least one top panel is in its container closing position.

In a preferred embodiment of the invention, the at least one top panel comprises a single rectangular top panel emanating from the top edge region of one of the side or end panels, and the at least one top support panel comprises two support panels emanating from end edge regions of the top panel, for positioning in juxtaposed relation to inside surfaces of the end or side panels of the container, when the side panels and end panels of the container are in their raised perpendicular positions relative to the bottom panel.

The self-erecting container of the present invention may further comprise a locking panel, emanating from the other of the side or end panels from that which the top panel emanates, and operably configured to engage portions of inside surfaces of the adjacent end or side panels, for maintaining said other of the side or end panels in its raised position substantially perpendicular to the bottom panel.

A locking tab may emanate from a free edge of the top panel, with a locking aperture, operably configured to receive the locking tab, for maintaining the top panel in the closed configuration.

The at least one top panel may comprise a top panel emanating from the top edge regions of opposed ones of the side panels or the end panels, and the at least one top support panel may comprise at least one top support panel, emanating from an end edge region of each top panel, for positioning in juxtaposed affixed overlying relation to an inside surface of the corresponding top panel.

In an embodiment of the invention, the at least one top support panel comprises at least one support panel emanating from a top edge region of at least one of the side and end panels of the container, for providing support for the at least one top panel, when the at least one top panel is positioned in its container closing position.

In an alternative embodiment of the invention, the end panels are non-rectangular in configuration, and the at least one top panel comprises a top panel emanating from the top edge regions of opposed ones of the side panels and the at least one top support panel comprises at least one support panel emanating from a top edge region of each of the end panels of the container, for providing support for the top panels, when the top panels are positioned in their container closing positions.

The invention may further comprise at least one handle panel, operably emanating from an edge region of the at least one top panel. At least one handle support panel may emanate from an end edge region of each handle panel, for positioning in juxtaposed affixed overlying relation to an inside surface of the corresponding handle panel.

Alternatively, the at least one handle panel may comprise one handle panel emanating from each of two top panels, the two handle panels being operably configured for positioning in juxtaposed overlying relation to one another.

At least one locking panel may be operably configured for maintaining the two handle panels in juxtaposed overlying relation to one another. At least one of the handle panels may be provided with a projecting locking member thereon, and the at least one locking panel comprises a panel having an aperture therein operably configured to engage the projecting locking member.

In each embodiment of the invention, the container may be fabricated from at least one of the following materials: paper, paperboard, cardboard, corrugated paperboard. Each container may be fabricated from a blank of container material having inner and outer surfaces, the inner surface having a layer of unlined corrugated medium disposed thereon.

The invention also comprises, in an alternative embodiment, a self-erecting container apparatus for rapid deployment into articulation for the facilitated containment of articles, with a bottom panel, having two opposed end edge regions and two opposed side edge regions. Two end panels emanate from the end edge regions of the bottom panel, and having two side edge regions. Two side panels emanate from the side edge regions of the bottom panel and having two side edge regions. A plurality of lines of weakness is disposed between the bottom panel and the end and side panels. A plurality of paired corner panels are provided. One panel of each corner panel pair emanates from a side edge region of an end panel, the other end panel of each corner panel pair emanating from a side edge region of a side panel. A line of weakness is disposed between the panels of each pair of corner panels. One panel of each pair of corner panels is folded into a position overlying and juxtaposed to the side or end panel from which the one panel emanates, and affixed thereto, upon folding of the underside panels into positions overlying and juxtaposed to the bottom panel, whereupon raising of the end or side panels into positions substantially perpendicular to the bottom panel causes the counterpart side or end panels to be drawn by the corner panel pairs likewise into positions substantially perpendicular to the bottom panel. The affixation of one panel of each pair of corner panels to the side or end panel to which they are juxtaposed is accomplished by the provision of adhesive to regions central to the respective one panel of each pair of corner panels.

In a further alternative embodiment of the invention, the container comprises a bottom panel, having two opposed end edge regions and two opposed side edge regions. Two end panels emanate from the end edge regions of the bottom panel, and having two side edge regions. Two side panels emanate from the side edge regions of the bottom panel and having two side edge regions. A plurality of lines of weakness is disposed between the bottom panel and the end and side panels. A plurality of paired corner panels is provided. A first panel of each corner panel pair emanates from a side edge region of an end panel, the second panel of each corner panel pair emanating from a side edge region of the first corner panel. A line of weakness is disposed between the panels of each pair of corner panels. One panel of each pair of corner panels is folded into a position overlying and juxtaposed to the side panel adjacent thereto, and affixed thereto, upon folding of the underside panels into positions overlying and juxtaposed to the bottom panel, whereupon raising of the end or side panels into positions substantially perpendicular to the bottom panel causes the counterpart side or end panels to be drawn by the corner panel pairs likewise into positions substantially perpendicular to the bottom panel. The affixation of one panel of each pair of corner panels to the side or end panel to which they are juxtaposed is accomplished by the provision of adhesive to regions central to the respective one panel of each pair of corner panels.

A further embodiment of the invention comprises a bottom panel, having two opposed end edge regions and two opposed side edge regions. Two end panels, emanate from the end edge regions of the bottom panel, and having two side edge regions. Two side panels emanate from the side edge regions of the bottom panel and having two side edge regions. A plurality of lines of weakness is disposed between the bottom panel and end and side panels. A plurality of paired corner panels is provided. One panel of each corner panel pair emanates from a side edge region of a side panel, the other panel of each corner panel pair emanating from a side edge region of the other corner panel of each corner panel pair. A line of weakness is disposed between the panels of each pair of corner panels. One panel of each pair of corner panels is folded into a position overlying and juxtaposed to the adjacent end panel, and affixed thereto, upon folding of the end and side panels into positions substantially oblique relative to the bottom panel, whereupon folding of the end panels into positions substantially overlying and parallel to the bottom panel, the end panels assume positions substantially parallel and coplanar with the bottom panel. The raising of the end and side panels into positions substantially oblique to the bottom panel causes the counterpart end or side panels to be drawn by the corner panel pairs likewise into positions substantially oblique to the bottom panel. At least one top panel is operably integrated into and emanates from a top edge region of one of the end panels, and operably configured for releasable affixation of the at least one top panel in a container closing position. At least one top support panel is operably associated with the top panel, for facilitating positioning of the at least one top panel, when the at least one top panel is in its container closing position.

BEST MODE FOR CARRYING-OUT THE INVENTION

Figure 1:
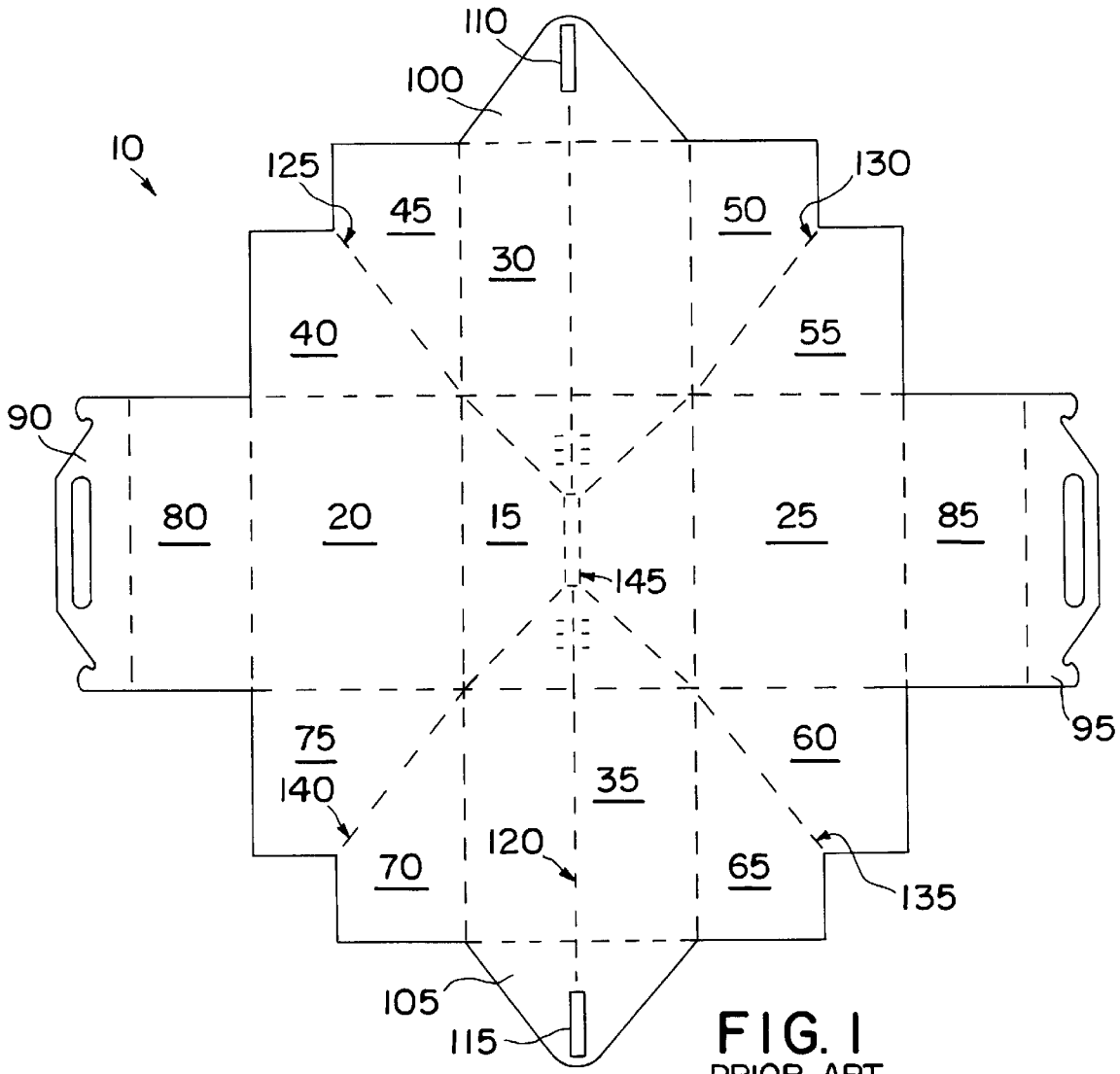
FIG. 1 PRIOR ART
FIG. 1 is a plan view of a blank for a prior art self-erecting container apparatus.

While this invention is susceptible of embodiment in many different forms, there is shown herein in the drawings and will be described in detail specific embodiments, with the understanding that the present disclosure is to be considered as an exemplification of the principles of the invention and is not intended to limit the invention to the embodiment illustrated.

FIG. 1 is a plan view of a prior art self-erecting container, corresponding to The Ice Cube™ corrugated cooler container manufactured by Wesland Container of Little Rock, Ark. Blank 10 comprises a bottom panel 15, side panels 20 and 25, end panels 30 and 35, paired corner panels 40 and 45, 50 and 55, 60 and 65, and 70 and 75. The corner panels are dimensioned and configured so that 40 is a mirror image of 45, 50 is a mirror image of 55 and so on. Top panels 80 and 85 have handles 90 and 95 emanating from them. Locking panels 100 and 105 emanate from top edges of ends panels 30 and 35, respectively, and are provided with slots 110 and 115 which engage hooks on handles 90 and 95, as illustrated. Fold lines separate each of the panels, as indicated by the broken lines. In addition, fold line 120 bisects blank 10. Diagonal fold lines 125, 130, 135 and 140 bisect each of the pairs of corner panels, and extend in straight lines into bottom panel 15, as shown in FIG. 1. In addition, a series of fold lines in the central area of bottom panel 15 define a rectangular area 145.

The manner of erecting the container 10, is as follows. Assume that the view of the blank, as shown in FIG. 1, is the inside surface of the container. As side panels 20 and 25 and end panels 30 and 35 are folded relative to bottom panel 15 toward the viewer, the diagonally extending fold lines between the respective corner panels 40, 45; 50, 55; 60, 65; and 70, 75 are forced inward so that the respective corner panels fold toward one another away from the viewer. Thus, when the side panels and end panels have attained a position which is substantially perpendicular to the bottom panel, the juxtaposed corner panels are to the inside of the substantially erected container.

During the folding and erecting process, adhesive is applied to the sides of one or both of each pair of corner panels on the side opposite the sides presented in FIG. 1, so that the corner panels become glued to one another. In addition, adhesive is applied to the "inside" surface of each of corner panels 40, 55, 60 and 75 to hold the juxtaposed paired corner panels against the inner surfaces of side panels 20 and 25. To close the lid/handle structure, top panels 80 and 85 are folded over toward one another so that they form a flat lidded structure. Handles 90 and 95 will become juxtaposed and will extend upwardly perpendicular to the top and bottom panels of the container. Locking panels 100 and 105 are then folded up and engage the hooks on the juxtaposed handles 90 and 95.

Once the container has been erected and glued as described, by exerting pressure on the side panels 20 and 25 toward one another, end panels 30 and 35 and their respective locking panels 100 and 105 will fold inwardly about the elongated fold line 120. At the same time, the bottom panel will collapse upon itself about the several fold lines 125–140 and about rectangular fold line 145, so that the collapsed bottom panel 15 projects outwardly, in the shape of a trapezoid. Thus, the entire structure can be substantially flattened so that side panels 20 and 25 become juxtaposed to one another.

Figure 2:
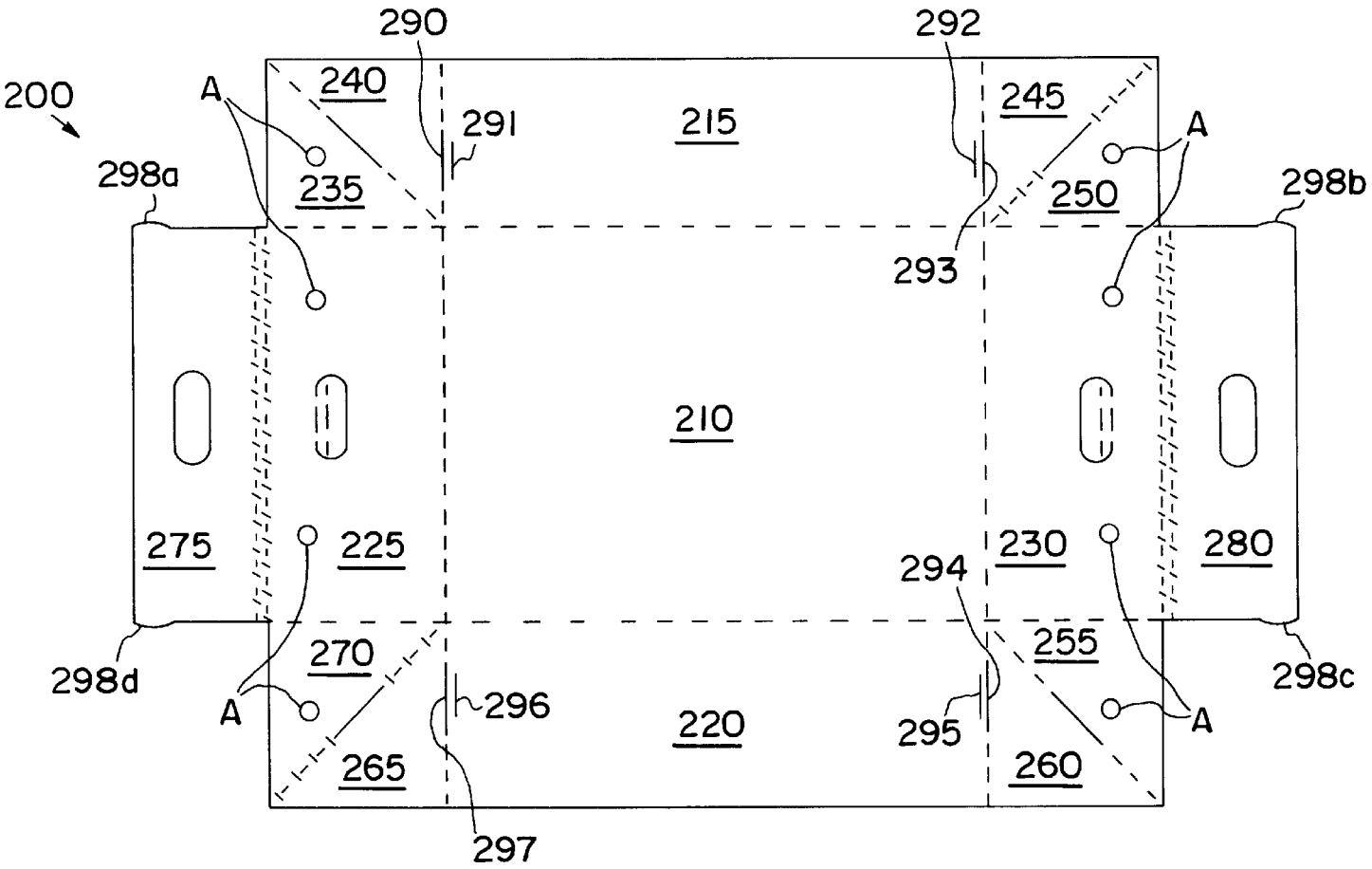
FIG. 2 is a plan view of a blank for a self-erecting container apparatus according to one embodiment of the present invention.

FIG. 2 illustrates a blank for a self-locking, self-erecting container according to an embodiment of the present invention. Blank 200 comprises bottom panel 210, side panels 215 and 220, end panels 225 and 230, paired corner panels 235, 240, 245, 250, 255, 260, 265 and 270. Locking panels 275 and 280 emanate from "upper" edges of end panels 225 and 230, respectively. Blank 200 is also provided with through-cuts 290, 291; 292, 293; 294, 295; and 296, 297.

Figure 2A:
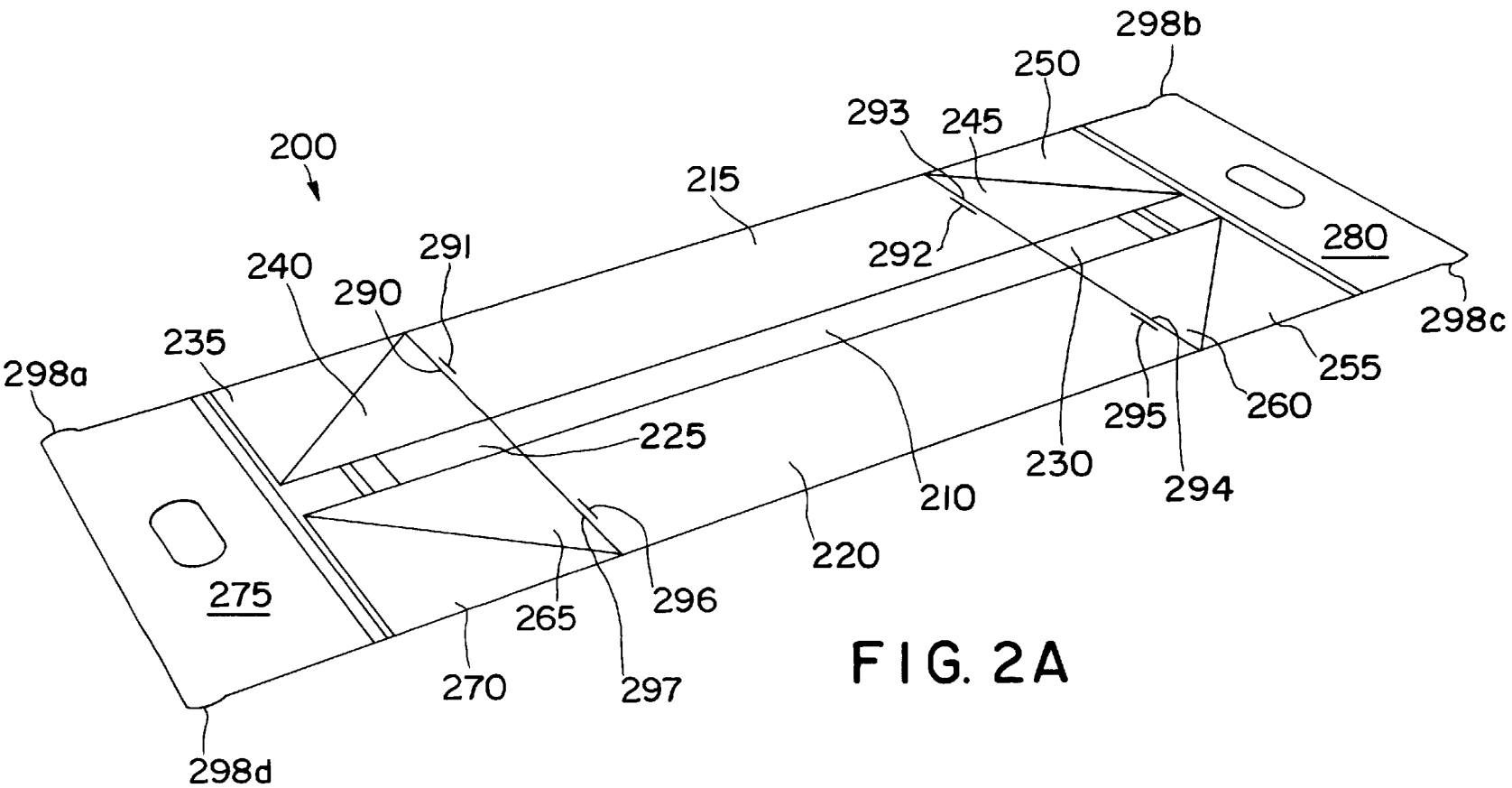
FIG. 2A is a perspective view of the folded and glued blank for the self-erecting container apparatus of FIG. 2.

To place the blank 200 into the self-erecting orientation, as shown in FIG. 2A, side panels 215 and 220 are folded about their respective fold lines to completely overly bottom panel 210, as the end panels are folded, adhesive is applied to corner panels 235, 250, 255 and 270 only against end panels 225 and 230, respectively. The adhesive is applied at one or more regions of each of panels 235, 250, 255 and 270 which include at least areas central to the panel. Adhesive may be applied from such central regions outwardly to the edges, if desired, but some adhesive needs to positioned at least in the central region of each of the respective panels (locations "A", generally, in FIG. 2) in order to securely affix them to end panels 225 and 230, respectively.

After the adhesive has set, upon raising side panels 215 and 220 to positions perpendicular to bottom panel 210, corner panels 240, 245, 260 and 265 pull against the corner panels 235, 250, 255 and 270 which have been fixedly attached to end panels 225 and 230. End panels 225 and 230 are pulled upwardly into positions perpendicular to bottom panel 210 and corner panels 240, 245, 260 and 265 become juxtaposed to their respective mated corner panels 235, 250, 255 and 270, respectively.

In order to lock the tray into its erected configuration, locking panels 275 and 280 are folded inward and into juxtaposed positions overlying end panels 225 and 230, respectively. Locking panels 275 and 280 are provided with rounded projections 298*a*–298*d*, as shown in FIG. 2, which, when locking panels 275 and 280 are folded inward, press into and push outwardly, the regions of panel material between the respective through-cuts 290, 291; 292, 293; 294, 295; and 296, 297 to create an interference fit between the projections and the opposing edges of the through-cuts. The locking panels are held in their inwardly and downwardly folded positions to maintain the side and end panels in their raised orientations relative to the bottom panel.

Once the tray has been erected, the way to collapse the tray is to pull the locking panels upward and outward to overcome the interference fit of the projections. Then the side panels may be folded flat against bottom 210 to create a substantially flattened self-erecting tray. Since the through-cuts are provided, as well as the handle holes, yielding leakage paths, the container of FIG. 2 is not a "slotless" container.

Figure 3A:
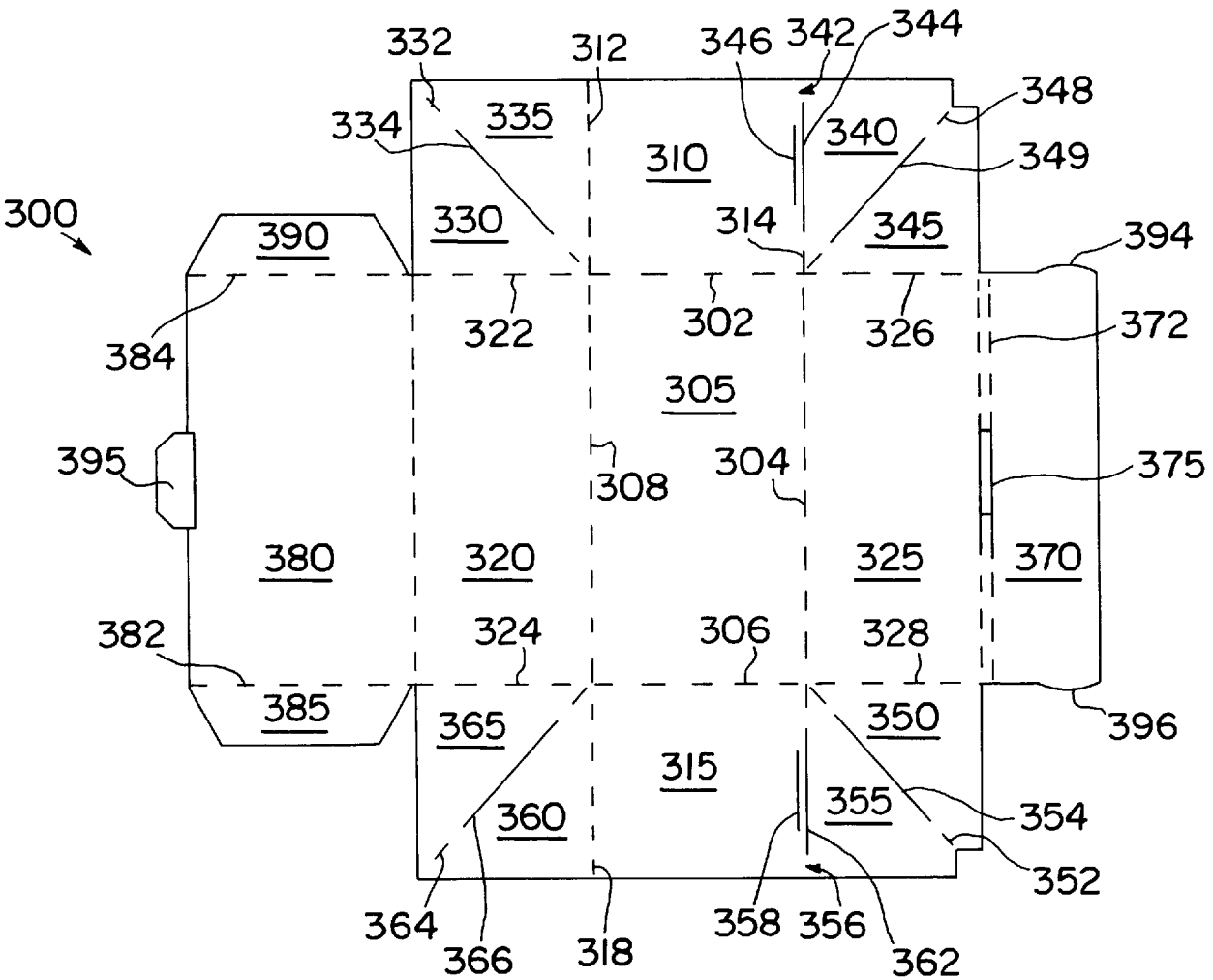
FIG. 3A is a plan view of a blank for a self-erecting container apparatus according to one embodiment of the present invention.

FIG. 3A illustrates a blank corresponding to a self-erecting container according to another embodiment of the invention. Blank 300 includes bottom panel 305, side panels 310 and 315, and end panels 320 and 325. Mated corner panels 330, 335; 340, 345; 350, 355; and 360, 365 are provided in the usual manner. A locking panel 370 emanates from the upper edge of end panel 325 and has a slot 375 provided at a position approximately midway along the length of the double scored fold between end panel 325 and locking panel 370.

Blank 300 is also provided with score lines 302, 304, 306, 308, 312, 314, 322, 324, 326, 328, 332, 342, 348, 352, 356, 364, 382 and 384. In a preferred embodiment of the invention, each of the score lines is actually a series of short cuts completely through the blank material, for facilitating ready folding of the container blank. In addition, blank 300 preferably is also provided with double score line 372, and elongated slits 334, 349, 354 and 366. Paired slits 344 and 346, and 358 and 362 are provided to cooperate with projections 394 and 396, as described hereinafter.

Figure 3B:
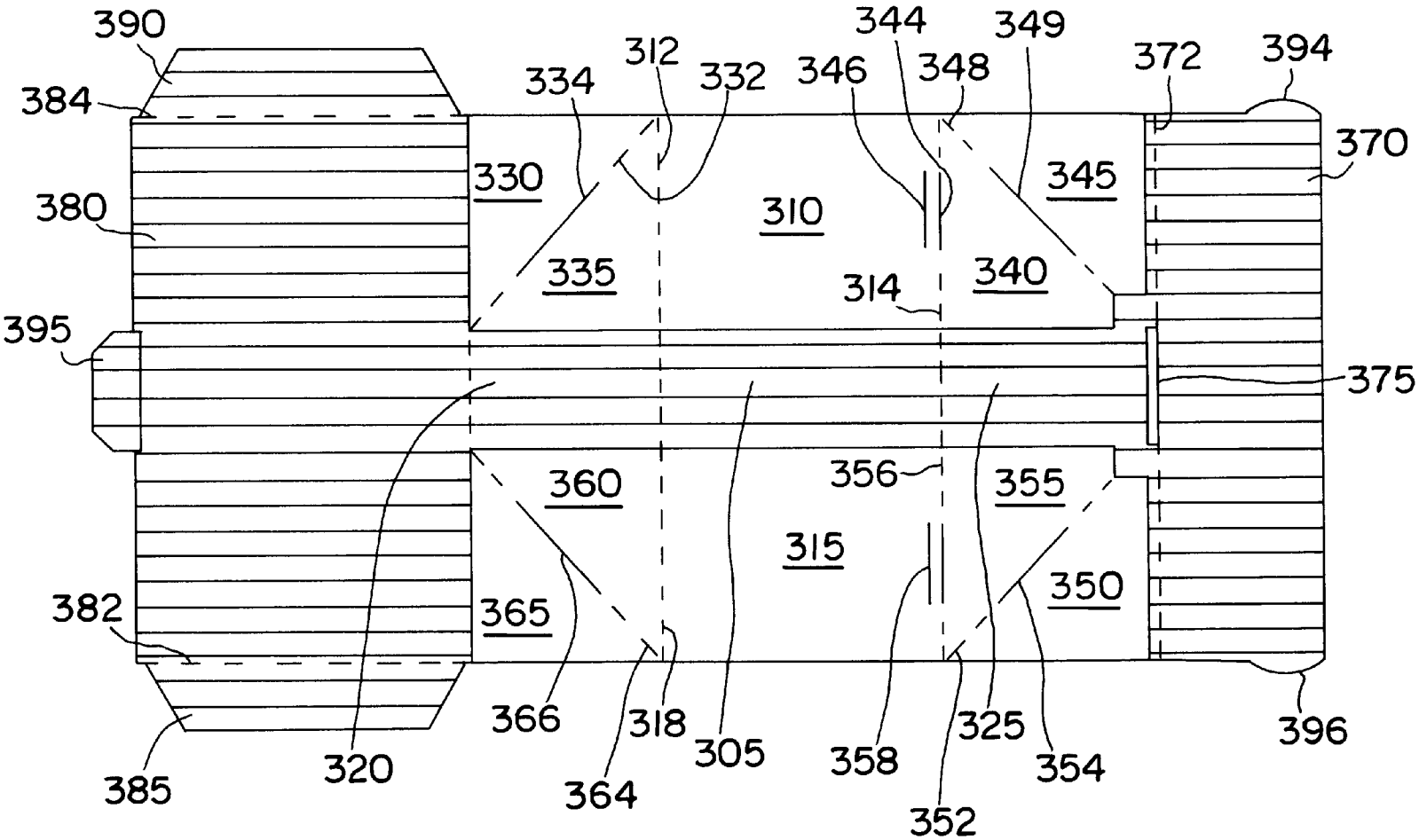
FIG. 3B is a plan view of the folded and glued blank of FIG. 3A, prior to raising of the side panels.

The "outer" corners of locking panel 370 are provided with projections 394, 396. A lid 380 emanates from the upper edge of end panel 320 and is provided with side panels 385 and 390 and a locking cap 395. Preparation of the blank into the self-erecting configuration is accomplished by folding side panels 310 and 315 over into juxtaposed positions relative to bottom panel 305, while applying adhesive to the inside surfaces of corner panels 330, 345, 350 and 365. This configuration is shown in FIG. 3B.

Figure 3C:
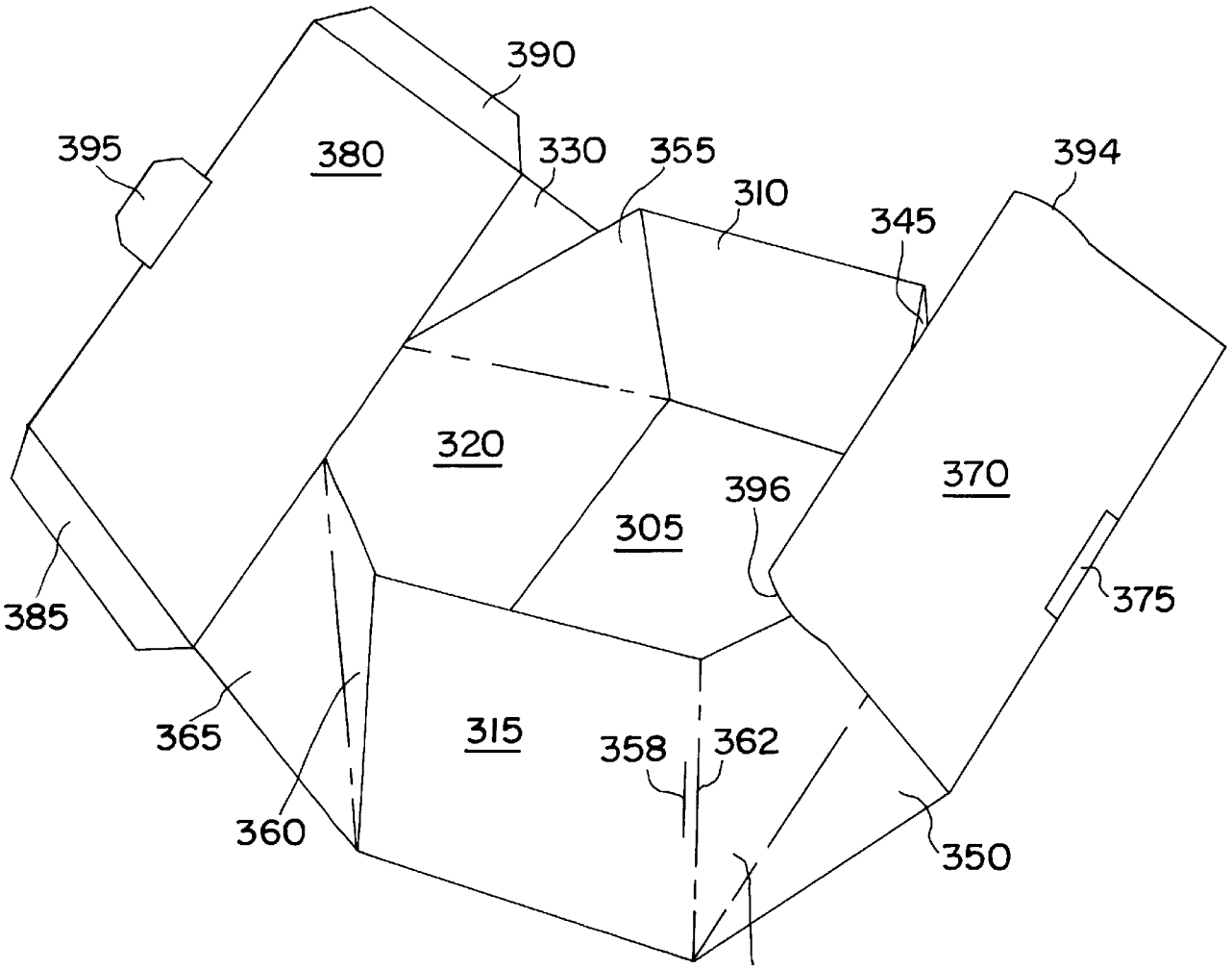
FIG. 3C is a perspective view of the blank of FIGS. 3A and 3B, showing the side panels partially raised, with the corner panels pulling the end panels upward.

Once the adhesive has set, upon pulling side panels 310 and 315 upward into perpendicular positions relative to bottom panel 305, corner panels 335, 340, 355 and 360 pull end panels 320 and 325 about their respective fold lines into perpendicular positions relative to bottom panel 305. FIG. 3C illustrates the configuration of the container, as the side panels 310 and 315 are being pulled upward, toward their positions perpendicular to the bottom panel 305. The corner panels can be seen to "pull" end panels 320 and 325 upwardly, toward the perpendicular, relative to bottom panel 305.

Alternatively, once the adhesive has set, upon pulling end panels 320 and 325 upward into perpendicular positions relative to bottom panel 305, corner panels 335, 340, 355 and 360 pull side panels 310 and 315 about their respective fold lines into perpendicular positions relative to bottom panel 305. FIG. 3C illustrates the configuration of the container, as the end panels 320 and 325 are being pulled upward, toward their positions perpendicular to the bottom panel 305. The corner panels can be seen to "pull" side panels 310 and 315 upwardly, toward the perpendicular, relative to bottom panel 305. That is, the self-erecting action is obtained whether the side or the end panels are the ones grasped and pivoted relative to the bottom. This is true for all of the other embodiments of the invention, of FIGS. 4–6, as well.

Locking panel 370 is then folded inward and downward, so that projections 394 and 396 engage and press outwardly the blank material between paired slits 344, 346 and 358, 362, to create an interference engagement of the projections, to affix at least end panel 325 into its perpendicular orientation relative to bottom panel 305.

To close the container and simultaneously affix end panel 320 into its perpendicular orientation relative to bottom panel 305, top panel 380 is folded over and perpendicular to bottom panel 305 with tabs 385 and 390 being folded perpendicular to top panel 380. Locking is achieved by inserting tab 395 into slot 375. The container of FIG. 3A is likewise not a "slotless" container, in view of the many perforations, and slits through its blank.

In a preferred embodiment of the container of FIG. 3A, the surface of the blank, which will become the inner surface, may be covered by non-lined corrugated medium, as shown in FIG. 3B. The unlined corrugated material will provide a plurality of resiliently yielding ridges which will act as dunnage surfaces, to provide cushioning from blows to the package. Depending upon their depth, the ridges may be used to help locate and position articles within the container. The corrugated medium on the inner surface of the blank is shown only in FIG. 3B, for ease of illustration of the container and its blank.

Figure 4:
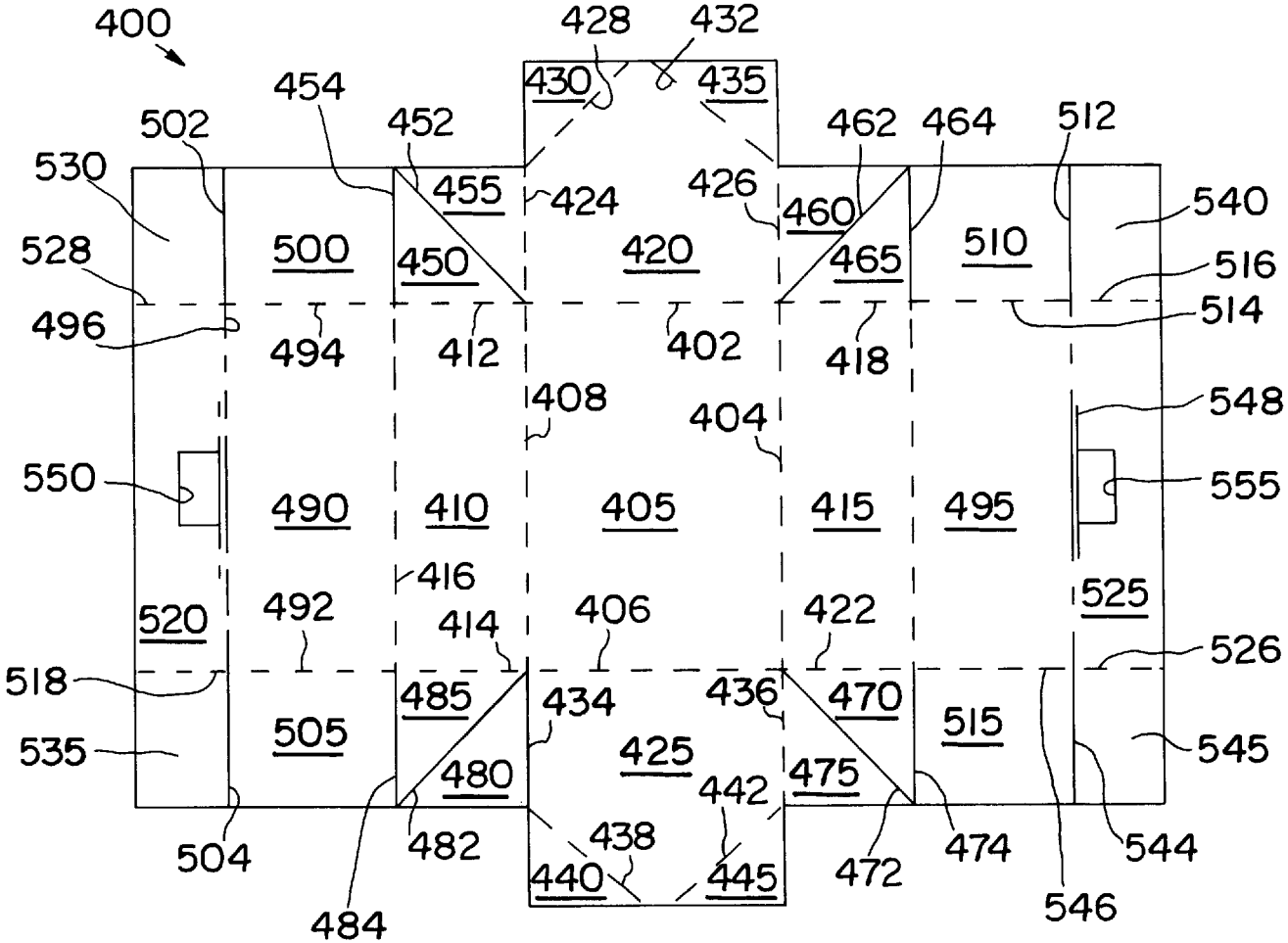
FIG. 4 is a plan view of a blank for a self-erecting container apparatus according to another embodiment of the present invention.

FIG. 4 is an illustration of a blank for a self-erecting container for another embodiment of the invention. Blank 400 comprises bottom panel 405, side panels 410 and 415, and end panels 420 and 425. Pentagonal end panels 420 and 425 are provided with lid support panels 430, 435, 440 and 445. Blank 400 also includes corner panels 450, 455, 460, 465, 470, 475, 480 and 485. Lid panels 490 and 495 emanated from upper edges of side panels 410 and 415 respectively. Top support panels 500, 505, 510 and 515 emanated from end edges of top panels 490 and 495 respectively. Handle panels 520 and 525 emanate from upper edges of top panels 490 and 495 respectively. Handle support panels 530, 535, 540 and 545 emanate from end edges of handle panels 520 and 525 respectively. Handle panels 520 and 525 are provided with diecut gripping apertures 550 and 555 respectively.

Blank 400 is provided with fold lines 402, 404, 406 and 408, which preferably do not involve puncturing or piercing the blank material. Score lines 412, 414, 416, 418, 422, 528, 494, 428, 432, 424, 426, 514, 516, 496, 518, 492, 494, 546, 526, 434, 438, 442, 436, and 548 may, in a preferred embodiment, comprise a series of through-cuts or perforations, for facilitating folding of the container material. Lines 502, 454, 452, 504, 484, 482, 472, 474, 544, 462, 464, and 512 preferably comprise complete cuts along their length, except at the peripheral edges of the blank where intermittent through-perforations are provided, in order to hold the adjoining panels together, during the folding and gluing steps described hereinafter.

To place the blank 400 into condition for self-deployment, end panels 420 and 425 are initially folded over into overlying relation juxtaposition relative to bottom panel 405. Simultaneously, panels 530 and 535 are affixed to handle panel 520, support panels 500 and 505 are affixed to top panel 490, and corner panels 450 and 485 are affixed to side panel 410. Corner panels 465 and 470 are affixed to side panel 415, support panels 510 and 515 are affixed to top panel 495 and support panels 540 and 545 are affixed to handle panel 525.

Upon pulling up of end panels 420 and 425 relative to bottom panel 405, side panels 410 and 415 are raised to perpendicular positions relative to bottom panel 405. Top support panels 430, 435, 440 and 445 are folded inward, to positions perpendicular to end panels 420 and 425. The top support panels 430, 435, 440 and 445 help support the top panels, and help prevent them from being pushed down between end panels 420, 425. The other support panels help provide rigidity and strength to the entire container structure, as well as to the specific panels which they support. Top panels 495 and 490 are brought against the edges of the peaks of end panels 420 and 425, to produce a peaked roof for the container. Handle panels 520 and 525 are brought into juxtaposition to one another, in positions perpendicular to bottom panel 405. In order to facilitate keeping the container in a closed orientation, one of the tabs produced by the diecutting of gripping apertures 550 and 555 may be left connected to the blank and not fully severed so that it can be pushed through the opposite corresponding handle aperture and folded upward to interlock the handle panels together.

Figure 5:
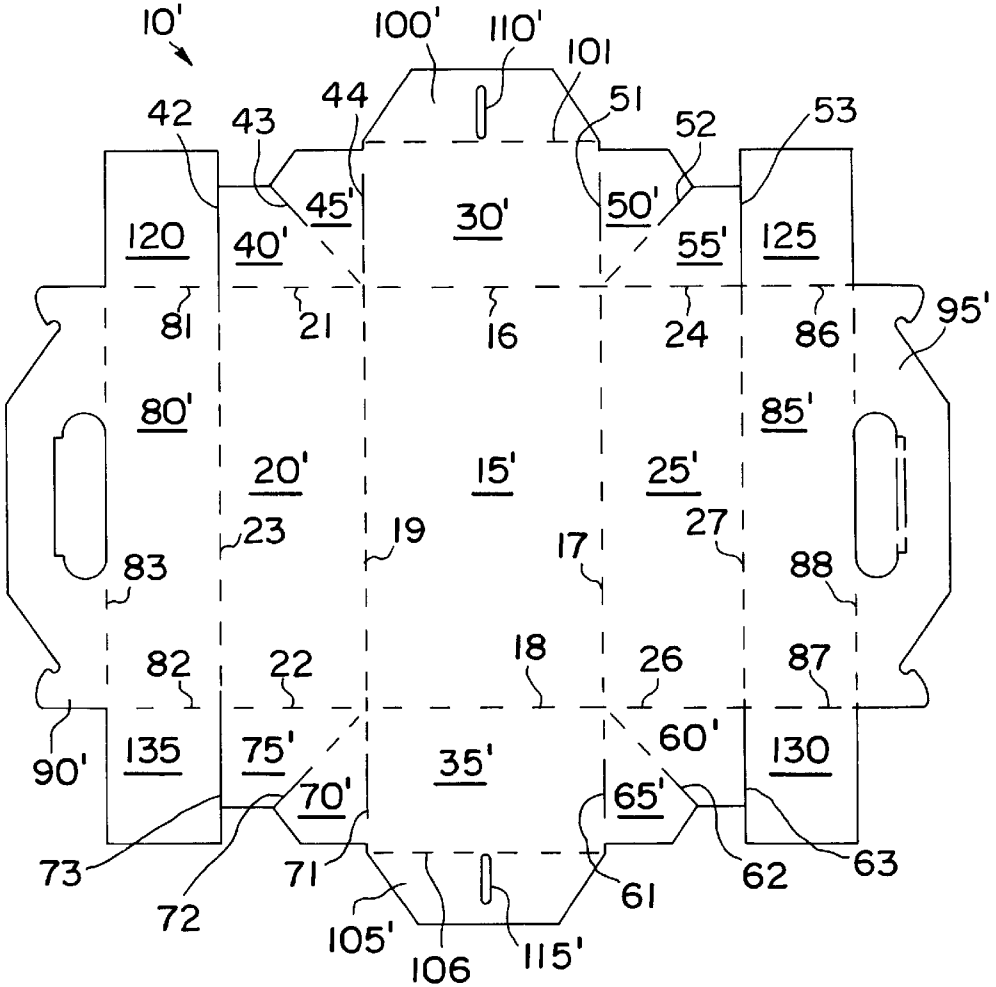
FIG. 5 is a plan view of a blank for a self-erecting container apparatus according to another embodiment of the present invention.

FIG. 5 is an illustration of a blank for a self-erecting container corresponding to still another embodiment of the invention. The overall layout in terms of the number of panels and their relationships to one another in the embodiment of FIG. 5 is as follows.

Blank 10' comprises a bottom panel 15', side panels 20' and 25', end panels 30' and 35', corner panels 40', 45', 50', 55', 60', 65', 70' and 75'. Top pane and 85' have handles 90' and 95' emanating from them. Locking panels 100' and 105' emanate from top edges of ends panels 30' and 35', respectively, and are provided with slots 110' and 115' which engage hooks on handles 90' and 95', as illustrated.

Blank 10' is provided with fold lines 16, 17, 18, 19, 21, 22, 23, 24, 26, and 27, 43, 52, 62 72, 81, 82, 86, 87, 101 and 106, which preferably do not involve puncturing or piercing the blank material. Score lines 42, 53, 63 and 73 preferably are double score lines, with perforations extending completely through the blank material for facilitating folding of the container material. Lines 88 and 83 preferably are single score lines, with perforations extending completely through the blank material.

To create the partially erected container, end panel 30' and its corresponding panels 120, 40', 45', 50', 55' and 125 are folded over toward the center of the blank, into juxtaposed overlying relation to bottom panel 15', and panels 80', 20', 25' and 85'. Panel 40' is affixed to panel 20', and panel 55' is affixed to panel 25'. Panel 100' is then folded back around fold line 101 toward fold line 16. End panel 35' and its corresponding panels 135, 75', 70', 65', 60' and 130 are folded over toward the center of the blank, into juxtaposed overlying relation to bottom panel 15'. Panel 135 is affixed to panel 120, panel 75' is affixed to panel 20', panel 60' and panel 130 is affixed to panel 125. In one preferred embodiment, in which the bottom panel is approaching a square, and the height of the end and side panels are close to the length and width of the bottom panel, the panels may be sized and proportioned so that, upon such folding, panel 70' overlaps panel 45', end panel 35' and locking panel 105' overlap end panel 30', and panel 65' overlaps panel 50'. Depending upon the relative proportions of the length, width and height of the container to be formed, the aforementioned overlapping may not take place, or may be provided to a greater or lesser degree.

Assume that the view of the blank, as shown in FIG. 5, is the inside surface of the container. As side panels 20' and 25' and end panels 30' and 35' are folded relative to bottom panel 15' toward the viewer, the diagonally extending fold lines between the respective corner panels 40', 45'; 50', 55'; 60', 65'; and 70', 75' are forced inward so that the respective corner panels fold toward one another away from the viewer. Thus, when the side panels and end panels have attained a position which is substantially perpendicular to the bottom panel, the juxtaposed corner panels are to the inside of the substantially erected container.

During the folding and erecting process, adhesive is applied to the sides of one or both of each pair of corner panels on the side opposite the sides presented in FIG. 5, so that the corner panels become glued to one another. In addition, adhesive is applied to the "inside" surface of each of corner panels 40', 55', 60' and 75' to hold the juxtaposed paired corner panels against the inner surfaces of side panels 20' and 25'. To close the lid/handle structure, top panels 80' and 85' are folded over toward one another so that they form a flat lidded structure. Handles 90' and 95' will become juxtaposed and will extend upwardly perpendicular to the top and bottom panels of the container. Locking panels 100' and 105' are then folded up and engage the hooks on the juxtaposed handles 90' and 95'.

Top panel supports 120, 125, 130 and 135 emanate from end edges of top panels 80' and 85'. In a preferred embodiment of the invention, there is a difference in the relative proportions of the respective support panels 120, 125, 130 and 135, so that support panels 130 and 135, for example, are longer than support panels 120 and 125. When end panels 30' and 35' are folded over bottom panel 115', panels 135 and 130 overlap panels 120 and 125, and the support panels are adhered to one another in the overlapping.

Adhesive is applied between panels 40' and 75' and side panel 20' and between panels 55' and 60' and panel 25'. In addition, where panels 120 and 135 overlap, they are affixed to one another with adhesive and where panels 125 and 130 overlap one another, they are affixed to each other with adhesive. However, panels 120 and 135 are not affixed in any manner to panel 80' and panels 125 and 130 are not affixed in any manner to 85'. Panels 120 and 135 thus create a separate inner top panel to the container apart from panels 80' and 85'. When the joined panels 120 and 135, and 125 and 130, are brought into overlapping parallel relationship to bottom panel 15', the end edges of panels 120, 125, 130 and 135 are abutted by the bottoms of locking panels 100' and 105'.

Since the support panels 120, 125, 130 and 135 are not adhered to top panels 80' and 85', the overlapped and adhered support panels together create a separate reinforcing top, the ends of which bear against the end panels 30' and 35' where they meet locking panels 100' and 105', thus providing enhanced lateral strength, to prevent collapsing of end panels 30' and 35' toward one another.

Paired corner panels 40' and 45', 50' and 55', 60' and 65', and 70' and 75' are not mirror images of one another. The adhesively affixed corner panels, 40', 55', 60' and 75', are right trapezoids, with two parallel edges. The non-affixed corner panels, 45', 50', 65', and 70', are right trapezoids, with no parallel edges. Accordingly, when the container is fully erected, diagonal fold lines 43, 52, 72 and 62 do not extend to the top edge of side panels 20' and 25', and thus the completed container is not a slotless, leakproof container.

Figure 6:
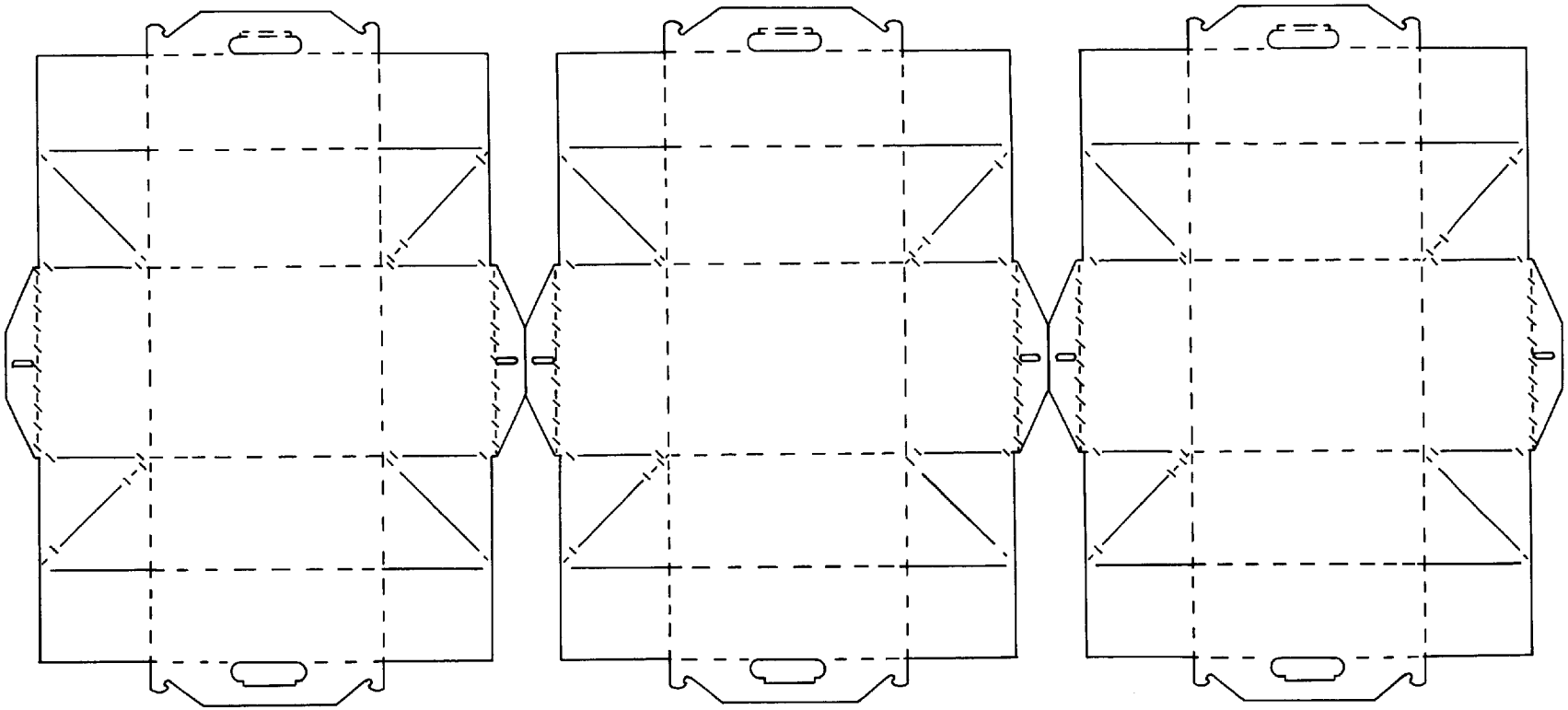
FIG. 6 is a plan view of a blank for a self-erecting container apparatus according to another embodiment of the present invention.

A further embodiment of the invention is illustrated in FIG. 6. The container of FIG. 6 is formed from a blank which is substantially similar to that of FIG. 5 (apart from the dimensions and proportions of the particular panels, which may vary from application to application, in a manner readily understandable by one of ordinary skill in the art having the present disclosure before them. Accordingly, only the salient differences between the embodiments of FIGS. 5 and 6 will be discussed in detail. In the embodiment of FIG. 6, the paired corner panels are substantially mirror images of each other, and each pair of corner panels forms a square. Further, the diagonal score lines separating the paired corner panels may be perforations or substantially elongated cuts. The support panels emanating from the top panels preferably may be connected to their adjoining corner panels by score lines which likewise may be perforations or substantially elongated cuts.

As a manufacturing method, the blanks may be die-cut, in a manner such that three (or more or less) blanks may be cut at the same time, from a single uncut sheet of container material, with the blanks being connected end-to-end (or side-to-side) by perforated regions for easy separation, as shown in FIG. 6.

Figure 7:
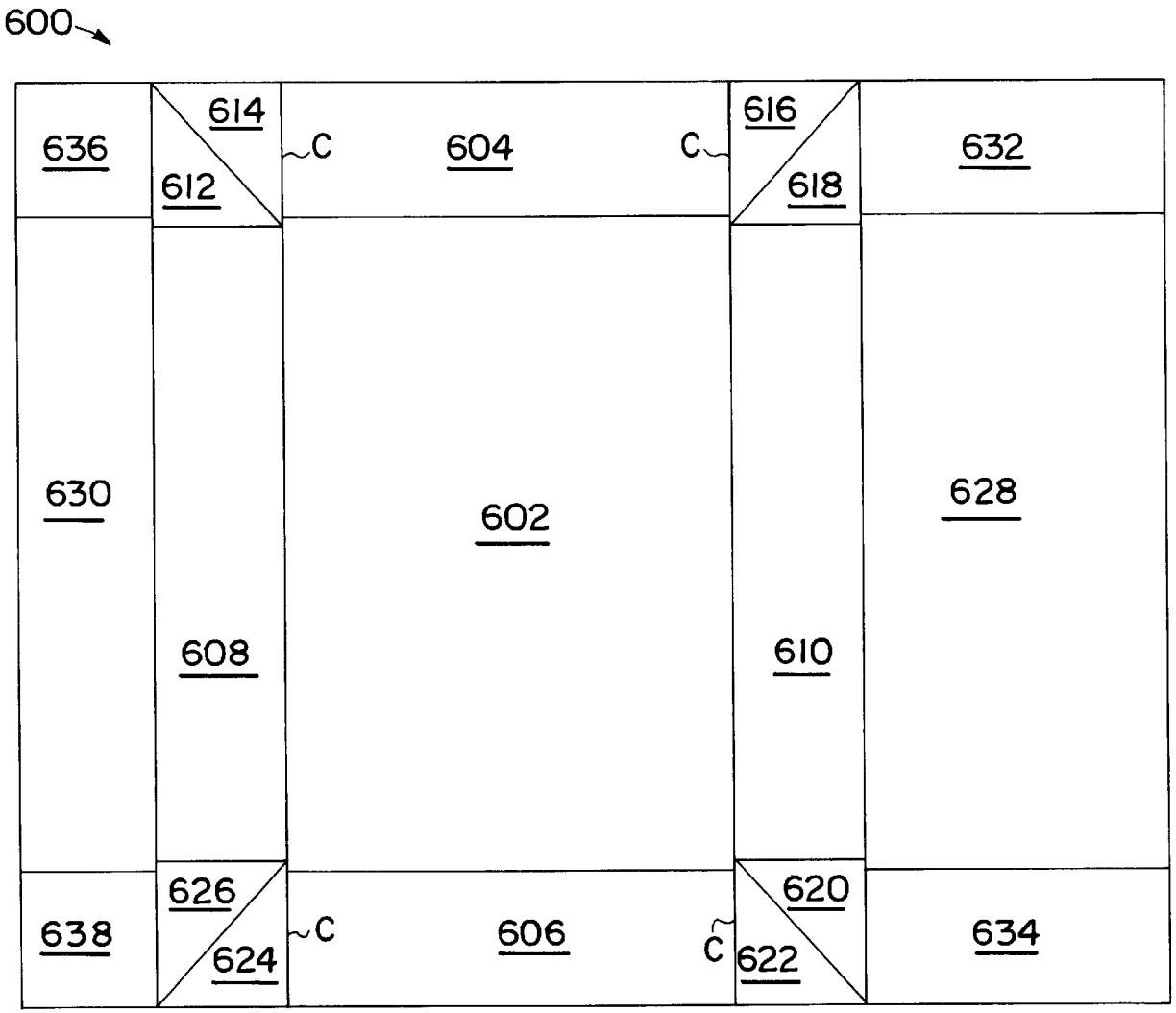
FIG. 7 is a plan view of a blank for a self-erecting container apparatus according to yet another embodiment of the invention.

FIG. 7 shows a blank for a further embodiment of the present invention. Blank 600 includes bottom panel 602, end panels 604 and 606 and side panels 608 and 610. Blank 600 also includes corner panels 612, 614, 616, 618, 620, 622, 624 and 626. The aforementioned panels are all connected to each other by fold lines and without any cuts. In addition, top panels 628 and 630 emanate from side panels 610 and 608, respectively. Top support panels 632 and 634 emanate from top panel 628 and are separated therefrom by fold lines. Top support panels 636 and 638 emanate from top panel 630 and are separated therefrom by fold lines. Cuts separate corner panel 612 from top support panel 636; corner 618 from top support panel 632; corner panel 620 from top support panel 634; and corner panel 626 from top support panel 638.

In an alternative embodiment of the invention instead of fold lines, cuts C may be provided between the end panels 604 and 606 and their adjacent panels 614, 616 and 622 and 624, respectively.

In order to put the blank into orientation to form the self-erecting container, first, side panel 608 is folded to a position overlying bottom panel 602. In doing so, corner panel 614 takes a position overlying a portion of end panel 604 and corner panel 624 takes a position overlying a portion of end panel 606. Corner panels 614 and 624 are then adhesively adhered to end panels 604 and 606. Then, side panel 610 is folded to a position overlying bottom panel 602. Corner panel 616 is adhesively adhered to end panel 604 and corner panel 622 is adhesively adhered to end panel 606. It may be readily observed from FIG. 7 that because top panel 628 is substantially wider than top panel 630, when the aforementioned folding attachment has taken place, top panel 628 will actually overlie substantially all of bottom panel 602 and substantially all of top panel 630 and side panel 608.

To raise the container to its use configuration, end panels 606 and 604 may be folded upwards to positions perpendicular to bottom panel 602 which, in turn, will force side panels 608 and 610 to assume positions perpendicular to end bottom panel 602. Pulling upward of folded-over panels 608 and 610 can accomplish the same end result. Top panels 628 and 630 then may be refolded over bottom panel 602 and top support panels 632, 634, 636 and 638, may be folded down to cover the sides of end panels 604 and 606, respectively. Top support panels 632, 634, 636 and 638 may be affixed in place to end panels 604 and 606 using any suitable method of attachment.

Figure 8:
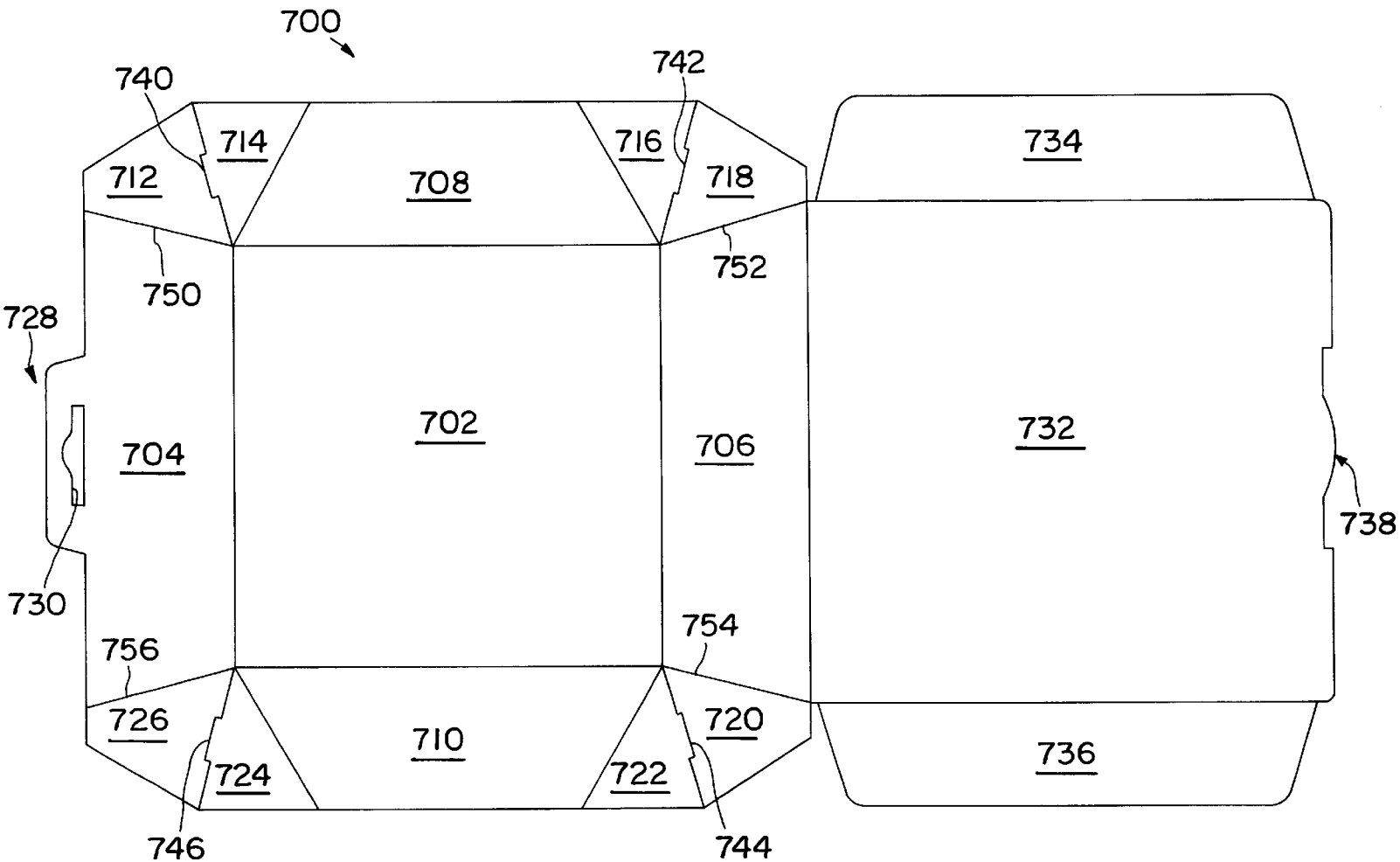
FIG. 8 is a plan view of a blank for forming a self-erecting container apparatus according to still yet another embodiment of the invention.

FIG. 8 is a plan view of a blank for still another embodiment of the invention.

Blank 700 includes bottom panel 702, end panels 704 and 706, side panels 708 and 710, and corner panels 712, 714, 716, 718, 720, 722, 724 and 726. Locking tab 728 emanates from end panel 704 and is provided with an aperture 730. Top panel 732 emanates from end panel 706 and has two top support panels 734 and 736 emanating from side edges therefrom. A locking tab 738 is formed on an edge of top panel 732, to engage aperture 730 in a manner to be described hereinafter. In one embodiment of the invention, C-shaped die cuts 740, 742, 744 and 746 are formed in the fold lines between the corner panels 712–714, 716–718, 720–722 and 724–726, respectively. In an alternative embodiment of the invention (not shown), the C-shaped die cuts may be omitted, leaving simple straight fold lines between each pair of adjacent corner panels.

Cuts 750, 752, 754 and 756 are provided between the end panels 704, 706 and their immediately adjacent corner panels 712, 718, 720 and 726, respectively.

To form the container, first, corner panels 712, 718, 720 and 726 are folded upward and inward about their common fold lines with their adjacent paired corner panels. Then, side panels 708 and 710 are folded upward and inwardly, as are end panels 704 and 706. Corner panels 712, 718, 720 and 726 are brought into juxtaposed overlying relation with inner surfaces of end panels 704 and 706, and adhered thereto. In the resulting configuration, the fold line between corner panels 712 and 714 is substantially aligned with the edge of end panel 704 resulting from cut 750; the fold line between corner panels 718 and 716 substantially aligns with the edge of end panel 706, resulting from cut 752; the fold line between corner panels 720 and 722 substantially aligns with the free edge of end panel 706 resulting from cut 754; and the fold line between corner panels 726 and 724 substantially aligns with the free edge of end panel 704 resulting from cut 756. The tabs in corner panels 714, 716, 722 and 724, resulting in C-shaped cuts 740, 742, 744 and 746, abuttingly engage the free edges of end panels 704 and 706 to facilitate alignment of the respective corner panels. Following such alignment, corner panels 712 and 726 are preferably adhesively adhered to the inside surface of end panel 704, and corner panels 718 and 720 are preferably adhesively affixed to the inside surface of end panel 706. Once the adhesive has been set, the resultant container comprises a bottom portion having a generally pyramidal shape with the attached top panel 732 and top support panels 734 and 736. The container can then be collapsed by folding end panels 704 and 706 inwardly about their respective fold lines they have in common with bottom panels 702. Simultaneously, side panels 708 and 710 are forced outwardly and downwardly to positions coplanar with bottom panel 702. Top panel 732 assumes a position partially overlying the flat-folded bottom of the container.

Erecting and closing the container is accomplished by raising up end panel 704 and 706, folding top support panels 734 and 736 to positions inward of the side edges of top panel 732, and thereafter folding top panel 732 to a position overlying and substantially parallel to bottom panel 702. Top support panels 734 and 736 will be slidingly received to positions inside of and adjacent side panels 708 and 710.

Upon the folding over of top panel 732 to a position overlying and substantially parallel to bottom panel 702, upon continued application of pressure, locking tab 738 will be forced passed the free edge of locking tab 728 and will enter into aperture 730 and project outwardly slightly beyond the aperture to provide positive locking interengagement of locking tab 738 with locking tab 728 to maintain the container in a substantially closed stable configuration. Release of the top panel is achieved by a combination of pulling locking tab 728 outwardly relative to the closed container and/or simultaneously pressing locking tab 738 inwardly back through aperture 730 to release top panel 732.

The containers of the embodiments of FIGS. 2–8 may be fabricated from paper, paperboard, cardboard or corrugated paperboard. Preferably, corrugated paperboard will be used.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A self-erecting container apparatus for rapid deployment into articulation for the facilitated containment of articles, comprising:

a bottom panel, having two opposed end edge regions and two opposed side edge regions;

two end panels, emanating from the end edge regions of the bottom panel, and having two side edge regions;

two side panels, emanating from the side edge regions of the bottom panel, and having two side edge regions;

a plurality of lines of weakness disposed between the bottom panel and the end and side panels;

a plurality of paired corner panels, one panel of each corner panel pair emanating from one of said side edge regions of one of said end panels, the other panel of each corner panel pair emanating from one of said side edge regions of one of said side panels;

a line of weakness disposed between the panels of each pair of corner panels;

one panel of each pair of corner panels being folded into a position overlying and juxtaposed to the side or end panel from which the one panel emanates, and affixed thereto, upon folding of the end or side panels into positions overlying and juxtaposed to the bottom panel, whereupon raising of the end or side panels into positions substantially perpendicular to the bottom panel causes the counterpart side or end panels to be drawn by the corner panel pairs likewise into positions substantially perpendicular to the bottom panel;

at least one top panel, operably integrated into and emanating from a top edge region of one of the side panels, and operably configured for releasable affixation of the at least one top panel in a container closing position;

at least one top support panel, operably associated with the top panel, for facilitating positioning of the at least one top panel, when the at least one top panel is in its container closing position; and at least one handle member, emanating from an edge of a top panel and operably configured, upon articulation of the container into its raised configuration, to extend substantially away from said container to permit grasping and carrying of the container.

2. The self-erecting container according to claim 1, wherein the at least one top panel comprises a single rectangular top panel emanating from the top edge region of one of the side or end panels, and the at least one top support panel comprises two support panels emanating from end edge regions of the top panel, for positioning in juxtaposed relation to inside surfaces of the end or side panels of the container, when the side panels and end panels of the container are in their raised perpendicular positions relative to the bottom panel.

3. The self-erecting container according to claim 1, wherein the at least one top panel comprises a top panel emanating from the top edge regions of each of opposed ones of the side panels or the end panels, and the at least one top support panel comprises at least one top support panel, emanating from an end edge region of each top panel, for positioning in juxtaposed affixed overlying relation to an inside surface of the corresponding top panel.

4. The self-erecting container according to claim 1, wherein the at least one top support panel comprises at least one support panel emanating from a top edge region of at least one of the side and end panels of the container, for providing support for the at least one top panel, when the at least one top panel is positioned in its container closing position.

5. The self-erecting container according to claim 1, wherein the end panels are non-rectangular in configuration, and the at least one top panel comprises a top panel emanating from the top edge regions of each of opposed ones of the side panels and the at least one top support panel comprises at least one support panel emanating from a top edge region of each of the end panels of the container, for providing support for the top panels, when the top panel are positioned in their container closing positions.

6. The self-erecting container according to claim 1, further comprising:

at least one handle panel, operably emanating from an edge region of the at least one top panel.

7. The self-erecting container according to claim 6, further comprising:

at least one handle support panel, emanating from an end edge region of each handle panel, for positioning in juxtaposed affixed overlying relation to an inside surface of the corresponding handle panel.

8. The self-erecting container according to claim 6, wherein the at least one top panel comprises two tog panels and the at least one handle panel comprises one handle panel emanating from each of said two top panels, the two handle panels being operably configured for positioning in juxtaposed overlying relation to one another.

9. The self-erecting container according to claim 8, further comprising at least one locking panel, operably configured for maintaining the two handle panels in juxtaposed overlying relation to one another.

10. The self-erecting container according to claim 9, wherein at least one of the handle panels is provided with a projecting locking member thereon, and the at least one locking panel comprises a panel having an aperture therein operably configured to engage the projecting locking member.

11. The self-erecting container according to claim 1, wherein the container is fabricated from at least one of the following materials: paper, paperboard, cardboard, corrugated paperboard.

12. The self-erecting container according to claim 1, wherein the container is fabricated from a blank of container material having inner and outer surfaces, the inner surface having a layer of unlined corrugated medium disposed thereon.

13. A self-erecting container apparatus for rapid deployment into articulation for the facilitated containment of articles, comprising:

a bottom panel, having two opposed end edge regions and two opposed side edge regions;

two end panels, emanating from the end edge regions of the bottom panel, and having two side edge regions;

two side panels, emanating from the side edge regions of the bottom panel and having two side edge regions;

a plurality of lines of weakness disposed between the bottom panel and the end and side panels;

a plurality of paired corner panels, one panel of each corner panel pair emanating from one of said side edge regions of one of said end panels, the other end panel of each corner panel pair emanating from one of said side edge regions of one of said side panels;

a line of weakness disposed between the panels of each pair of corner panels;

one panel of each pair of corner panels being folded into a position overlying and juxtaposed to the side or end panel from which the one panel emanates, and affixed thereto, upon folding of the end or side panels into positions overlying and juxtaposed to the bottom panel, whereupon raising of the end or side panels into positions substantially perpendicular to the bottom panel causes the counterpart side or end panels to be drawn by the corner panel pairs likewise into position substantially perpendicular to the bottom panel;

wherein the end panels are non-rectangular in configuration.

14. A self-erecting container apparatus for rapid deployment into articulation for the facilitated containment of articles, comprising:

a bottom panel, having two opposed end edge regions and two opposed side edge regions;

two end panels, emanating from the end edge regions of the bottom panel, and having two side edge regions;

two side panels, emanating from the side edge regions of the bottom panel, and having two side edge regions;

a plurality of lines of weakness disposed between the bottom panel and the end and side panels;

a plurality of paired corner panels, one panel of each corner panel pair emanating from one of said side edge regions of one of said end panels, the other panel of each corner panel pair emanating from one of said side edge regions of one of said side panels;

a line of weakness disposed between the panels of each pair of corner panels;

one panel of each pair of corner panels being folded into a position overlying and juxtaposed to the side or end panel from which the one panel emanates, and affixed thereto, upon folding of the end or side panels into positions overly and juxtaposed to the bottom panel, whereupon raising of the end or side panels into positions substantially perpendicular to the bottom panel causes the counterpart side or end panels to be drawn by the corner panel pairs likewise into positions substantially perpendicular to the bottom panels;

at least one top panel, operably integrated into and emanating from a top edge region of one of the side panels, and operably configured for releasable affixation of the at least one top panel in a container closing position;

at least one top support panel, operably associated with the top panel, for facilitating positioning of the at least one top panel, when the at least one top panel is in its container closing position;

wherein the at least one top panel further comprises a top panel emanating from the top edge regions of each of opposed ones of the side panels or the end panels, and the at least one top support panel comprises at least one top support panel, emanating from an end edge region of each top panel, for positioning in juxtaposed affixed overlying relation to an inside surface of the corresponding top panel.

15. A self-erecting container apparatus for rapid deployment into articulation for the facilitated containment of articles, comprising:

a bottom panel, having two opposed end edge regions and two opposed side edge regions;

two end panels, emanating from the end edge regions of the bottom panel, and having two side edge regions;

two side panels, emanating from the side edge regions of the bottom panel, and having two side edge regions;

a plurality of lines of weakness disposed between the bottom panel and the end and side panels;

a plurality of paired corner panels, one panel of each corner panel pair emanating from one of said side edge regions of one of said end panels, the other panel of each corner panel pair emanating from one of said side edge regions of one of said side panels;

a line of weakness disposed between the panels of each pair of corner panels;

one panel of each pair of corner panels being folded into a position overlying and juxtaposed to the side or end panel from which the one panel emanates, and affixed thereto, upon folding of the end or side panels into positions overly and juxtaposed to the bottom panel, whereupon raising of the end or side panels into positions substantially perpendicular to the bottom panel causes the counterpart side or end panels to be drawn by the corner panel pairs likewise into positions substantially perpendicular to the bottom panels;

at least one top panel, operably integrated into and emanating from a top edge region of one of the side panels, and operably configured for releasable affixation of the at least one top panel in a container closing position;

at least one top support panel, operably associated with the top panel, for facilitating positioning of the at least one top panel, when the at least one top panel is in its container closing position;

wherein the end panels are non-rectangular in configuration and the at least one top panel comprises a top panel emanating from the top edge regions of each of opposed ones of the side panels and the at least one top support panel comprises at least one support panel, emanating from a end edge region of each of the end panels of the container, for providing support for the top panels, when the top panels are positioned in their container closing positions.

* * * * *

UNITED STATES PATENT AND TRADEMARK OFFICE

CERTIFICATE OF CORRECTION

PATENT NO. : 6,155,479
DATED : December 5, 2000
INVENTOR(S) : Wellner et al.

It is certified that error appears in the above-identified patent and that said Letters Patent is hereby corrected as shown below:

Title page,
Item [73], delete "Stone Bridge Corporation" and insert -- Stone Container Corporation --

Column 9,
Line 66, delete "pane" and insert -- panel 80' --
Line 66, before "and 85", insert -- 80 --

Column 15,
Line 8, delete "tog" and insert -- top --

Signed and Sealed this

Seventeenth Day of September, 2002

*Attest:*

*Attesting Officer*

JAMES E. ROGAN
*Director of the United States Patent and Trademark Office*